United States Patent [19]

Kelland et al.

[11] Patent Number: 4,663,029

[45] Date of Patent: May 5, 1987

[54] METHOD AND APPARATUS FOR CONTINUOUS MAGNETIC SEPARATION

[75] Inventors: David R. Kelland, Lexington; Makoto Takayasu, Somerville, both of Mass.

[73] Assignee: Massachusetts Institute of Technology, Cambridge, Mass.

[21] Appl. No.: 720,879

[22] Filed: Apr. 8, 1985

[51] Int. Cl.[4] ..... B03C 1/00

[52] U.S. Cl. ..... 209/214; 209/212; 209/232

[58] Field of Search ..... 209/212–215, 209/223 R, 232, 8, 39, 40, 3, 231; 210/222, 223

[56] References Cited

U.S. PATENT DOCUMENTS

| | | | |
|---|---|---|---|
| 2,029,078 | 1/1936 | Matney | 210/131 |
| 2,258,194 | 10/1941 | Queneau | 209/232 |
| 2,943,739 | 7/1960 | Maynard | 210/223 |
| 3,346,116 | 10/1967 | Jones | 210/222 |
| 3,375,925 | 4/1968 | Carpenter | 209/214 |
| 3,483,968 | 12/1969 | Kaiser | 209/1 |
| 3,567,026 | 3/1971 | Kohm | 210/222 |
| 3,676,337 | 7/1972 | Kohn | 210/42 |
| 3,875,061 | 4/1975 | Palma | 210/223 |
| 3,902,994 | 9/1975 | Maxwell et al. | 209/213 |
| 3,970,518 | 7/1976 | Giaever | 195/1.5 |
| 4,102,780 | 7/1978 | Sun et al. | 209/39 |
| 4,187,170 | 2/1980 | Westcott et al. | 209/1 |
| 4,225,425 | 9/1980 | Price et al. | 209/8 |
| 4,230,685 | 10/1980 | Senyei et al. | 424/12 |
| 4,235,710 | 11/1980 | Sun | 209/213 |
| 4,261,815 | 4/1981 | Kelland | 209/213 |
| 4,526,681 | 7/1985 | Friedlaender et al. | 209/214 |
| 4,560,484 | 12/1985 | Friedlaender et al. | 210/223 |

FOREIGN PATENT DOCUMENTS

| | | |
|---|---|---|
| 558707 | 7/1977 | U.S.S.R. . |
| 649465 | 2/1979 | U.S.S.R. . |

OTHER PUBLICATIONS

"Performance of Parallel Stream Type Magnetic Filter for HGMS", Uchiyama et al., *IEEE Transactions on Magnetics*, vol. MAG. 12, No. 6, Nov. 1976.

"Single Wire Model of High Gradient Magnetic Separation Processes", Cowen et al, *IEEE Transactions on Magnetics*, vol. MAG. 13, No. 5, Sep. 1977.

"HGMS Studies of Blood Cell Behavior in Plasma", M. Takayasu et al., *IEEE Transactions on Magnetics*, vol. MAG. 18, No. 6, Nov. 1982.

(List continued on next page.)

*Primary Examiner*—Robert B. Reeves
*Assistant Examiner*—Donald T. Hajec
*Attorney, Agent, or Firm*—Hamilton, Brook, Smith & Reynolds

[57] ABSTRACT

Particles in a slurry are continuously separated in accordance with their magnetic moment by passing the slurry through a separator. The separator comprises a non-magnetic canister with a magnetized wire or rod extending adjacent to the canister. The wire is magnetized by a magnetic field $H_o$ to create a magnetization component transverse to the wire longitudinal axis. A field gradient extends everywhere within the canister space and exerts a radial force on particles passing through the canister. Depending upon the orientation of the magnetic field, vis-a-vis the canister, diamagnetic particles in the slurry can be attracted toward the wire and paramagnetic particles repelled (diamagnetic capture mode of operation); or vice-versa, for a magnetic field usually rotated by 90° with respect to the plane of the canister (paramagnetic capture mode of operation). Two or more laterally spaced outlets are provided at the bottom of the canister to collect the separated particles.

In a further embodiment of the invention, the single wire radial force apparatus of the invention is extended to a system for selective separation of particles, according to the particles magnetic susceptibility only; independent of density, size and shape of the particles. In this embodiment, a family of streams are fed into the canister. Each stream differs from each other stream by the magnetic susceptibilities of the fluids in the family of streams. A susceptibility gradient is thus established in the canister, which is used to separate particles in the stream.

27 Claims, 18 Drawing Figures

OTHER PUBLICATIONS

"Diamagnetic Particle Capture and Mineral Separation", Kelland et al, *IEEE Transactions on Magnetics* vol. MAG. 17, No. 6, Nov. 1981.

"Designing HGMS Matrix Arrays for Selective Filtration", C. deLatour et al., *IEEE Transactions on Magnetics,* vol. MAG. 19, No. 5, Sep. 1983.

"Matrices for Selective Diamagnetic HGMS", Takayasu et al., *IEEE Transactions on Magnetics,* vol. MAG. 17, No. 6, Nov. 1981.

"Axial Particle Trajectory Measurements in High--Gradient Magnetic Separation", *IEEE Transactions on Magnetics,* vol. MAG. 15, No. 2, Mar. 1979, F. Paul et al.

"High Gradient Magnetic Capture of Cells and Ferritin-Bound Particles", Charles S. Owen, *IEEE Transactions on Magnetics,* vol. MAG. 18, No. 6, Nov. 1982.

"Fractionation of Blood Components Using High Gradient Magnetic Separation", *IEEE Transactions on Magnetics,* vol. MAG. 18, No. 6, Nov. 1982, Melville et al.

"Transverse Particle Trajectories in High-Gradient Magnetic Separation", *IEEE Transactions on Magnetics* vol. MAG. 18, No. 6, Nov. 1982, F. Paul et al.

"Magnetic Separation Utilizing a Magnetic Susceptibility Gradient", Takayasu et al., *IEEE Transactions on Magnetics,* vol. MAG-20, No. 1, Jan. 1984.

"Application of Magnetic Susceptibility Gradients to Magnetic Separation", Hwang et al., *J. Appl. Phys.* 55(6), Mar. 15, 1984.

"Status of Magnetic Separation", Friedlaender et al., *Journal of Magnetism and Magnetic Materials,* 15-18(1980), 1555-1558.

"Magnetic Separation of the Second Kind: Magnetogravimetric, Magnetohydrostatic, and Magnetohydrodynamic Separations", S. E. Khalafalla, *IEEE Transactions on Magnetics,* vol. MAG-12, No. 5, Sep. 1976.

"Characterization of Magnetic Forces by Means of Suspended Particles in Paramagnetic Solutions", Zimmels et al., *IEEE Transactions on Magnetics,* vol. MAG-12, No. 4, Jul. 1976.

"Measurement of Specific Gravity and Magnetic Susceptibility of Particulate Materials by Levitation in Paramagnetic Solutions", Y. Zimmels, *IEEE Transactions on Magnetics,* vol. Mag-13, No. 2, Mar. 1977.

"Principles of High-Gradient Magnetogravimetric Separation", Zimmels et al., *IEEE Transactions on Magnetics,* vol. Mag-13, No. 4, Jul. 1977.

"Mineral Stratification in Magnetohydrostatic Separation", Yaniv et al., *Separation Science and Technology,* 14(4), pp. 261-290, 1979.

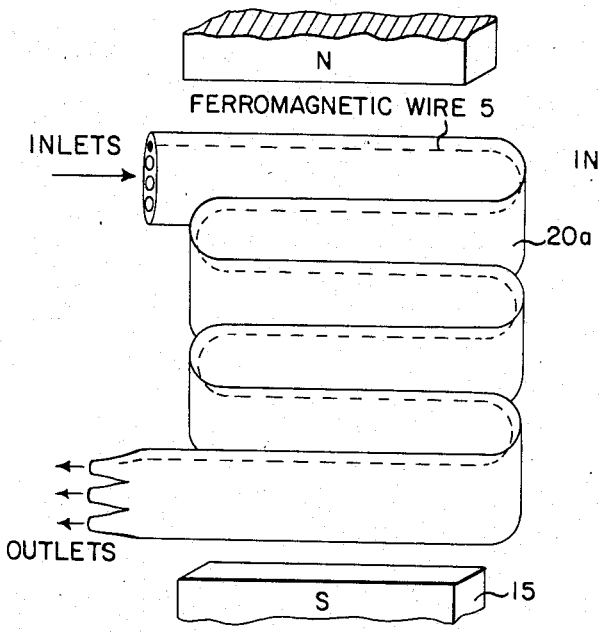
Fig.7a
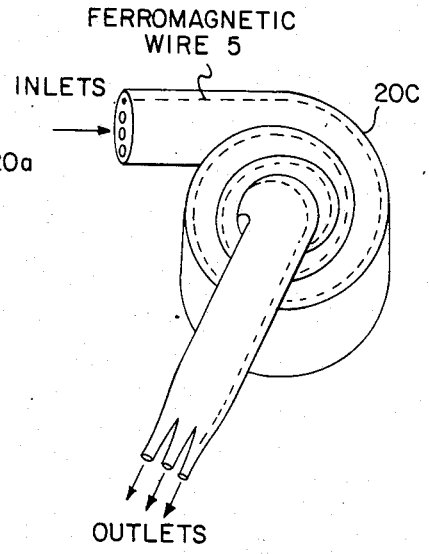
Fig.7c
Fig.7b
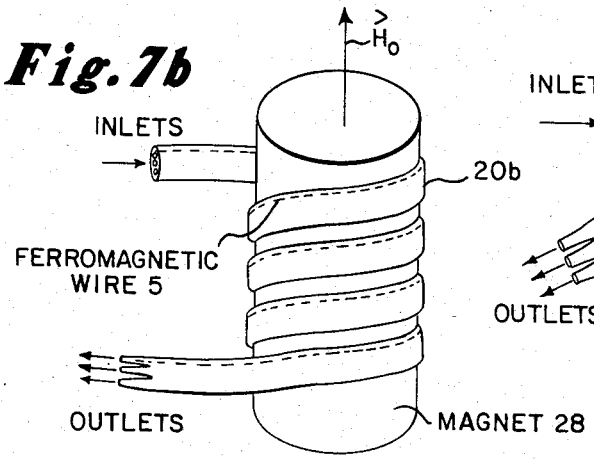
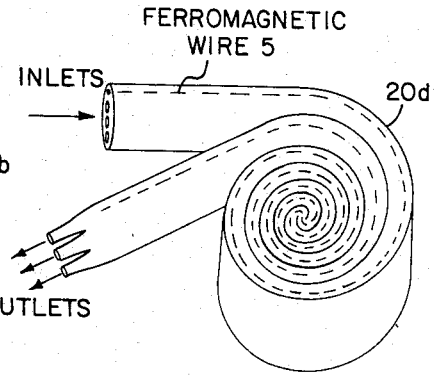
Fig.7d
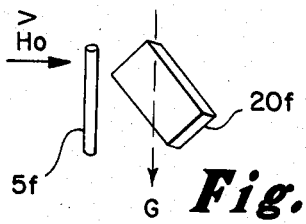
Fig.7f
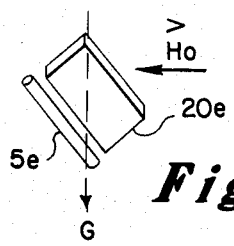
Fig.7e

METHOD AND APPARATUS FOR CONTINUOUS MAGNETIC SEPARATION

The Government has rights in this invention pursuant to Grant No. 8120442-CPE, awarded by the National Science Foundation.

DESCRIPTION

1. Technical Field

This invention is in the field of High Gradient Magnetic Separation (HGMS). 2. Background Art This invention is an improvement upon the Kelland-type magnetic separator described in U.S. Pat. No. 4,261,815 issued Apr. 14, 1981, which in turn was an improvement upon the Kolm-type magnetic separator described in U.S. Pat. No. 3,676,337 issued July 11, 1972.

The Kolm-type separator employs a fibrous matrix, such as steel wool; subjected to a D.C. magnetic field. The magnetized wool provides a large number of regions of high magnetic field gradient, i.e., rate of change of magnetic field (H) per unit of distance (X), or dH/dX, in the path of a slurry to attract and retain magnetic particles passing in the slurry.

The Kolm-type separator traps particles, and cannot be operated continuously, since the trapped particles must be removed from the matrix during part of the duty cycle. Alternatively, the matrix can be removed from the separator and cleared of trapped particles, as in the continuous Carousel-type separator, U.S. Pat. No. 3,902,994 to Maxwell et al. issued Sept. 2, 1975.

The Kelland-type separator utilizes differences in the magnetic susceptibility ($\chi$) of particles in a fluid to effectuate separation. Such particles can be separated in accordance with the relative magnetic susceptibility of the particles $\chi_p$ in the slurry versus the fluid susceptibility $\chi_s$ therein.

There are three main classes of magnetic materials: ferromagnetic, paramagnetic and and diamagnetic. Susceptibility $\chi$ is considered to be positive for the first two and negative for diamagnetic materials. Diamagnetic materials experience a force in the direction of weaker field. The direction of the force is opposite to that which paramagnetic and ferromagnetic particles experience in a magnetic field gradient. Fluids are often diamagnetic, e.g., most organics and water. The susceptibility, $\chi_3$, of a liquid can be changed by dissolving paramagnetic or diamagnetic salts therein. The well-known case of $MnCl_2$ (strongly paramagnetic) in water is an example of a liquid in which a diamagnetic or weakly paramagnetic particle experiences a larger force when $(\chi_p-\chi_s)$ is enhanced in magnitude.

The Kelland-type separator comprises an elongate non-magnetic outer housing for receiving a slurry of magnetic and small susceptibility ($\chi_p$) particles which may be considered as effectively "non-magnetic". The slurry flows axially through the housing. A plurality of small-diameter, ferromagnetic rods or wires are disposed within and oriented parallel to the axis of the housing (and hence parallel to the flow velocity of the fluid stream of slurry). The rods are transversely spaced from one another. Downstream from one end of each rod the housing is divided into a plurality of open-ended transversely spaced channels formed of aluminum or other non-magnetic material. A group of four such channels are disposed about each rod and act as a unit. Two channels of the group form collection channels and have open ends forming the collection zones of the separator for collecting particles of a given sign of relative susceptibility $(\chi_p-\chi_s)$. The other two channels form depletion channels and have open ends forming a depletion zone for those same particles; but forming collection zones for particles in which $(\chi_p-\chi_s)$ has the opposite sign. The volume within the housing between one end of each rod and the open ends of the channels is a separation region. A magnetic field is provided in the separation region which is oriented transversely to the longitudinal axes of the parallel rods.

The magnetic field is distorted by the presence of the ferromagnetic rods in such a way as to produce in certain regions about each rod a magnetic field gradient. As the slurry moves in a stream axially along the rods, radial forces and azimuthal forces due to the magnetic field and its gradient act to concentrate those particles in the slurry with a given sign (+ or −) of relative susceptibility $(\chi_p-\chi_s)$ at the collection zones where they are collected by the collection channels and to deplete these magnetic particles in the slurry at the depletion zones where the depletion channels of a group collect slurry with a high proportion of particles with the opposite sign (− or +) of $(\chi_p-\chi_s)$.

The Kelland-type separator represents a significant improvement over the prior art in terms of higher selectivity of a separation of complex particle systems, such as mineral ores. However, still further improvement is required for complex particle systems in which all the several particle types have the *same* sign for $(\chi_p-\chi_s)$ but only differ in magnitude and in order to separate micron size particles of very small susceptibility or submicron size particles.

With decreasing particle size, it becomes increasingly more difficult to separate particles by a magnetic separation process. This is because hydrodynamic drag forces become more significant than magnetic forces. Furthermore, Brownian motion dominates the kinematics of submicron particles and thus affects the capture process. Besides the need for the separation of such small particles, biological materials almost always have very small values of diamagnetic susceptibility. One exception is the relative susceptibility of deoxygenated red blood cells in whole blood. Plasmapheresis, wherein plasma is separated from the cellular elements of whole blood can be accomplished magnetically by a high gradient magnetic separation. Another application involves the separation of cells attached to magnetic beads.

DISCLOSURE OF THE INVENTION

In the present invention, particles in a slurry are continuously separated in accordance with their magnetic susceptibility and their size by passing the slurry through a separator comprising a non-magnetic canister. Note that the product of a particle's susceptibility ($\chi_p$) times the field ($\overline{H}$) times the particle size or volume (Vp) is hereinafter referred to as the "magnetic moment" of the particle. A magnetized wire or rod extends adjacent to the canister. The term "adjacent" is meant to encompass a wire within or outside the canister. The wire is magnetized by a magnetic field $H_o$ to create a magnetization component transverse to its longitudinal axis. A field gradient extends within the canister and exerts a radial force on particles passing through the canister. Depending upon the orientation of the magnetic field, vis-a-vis the canister, diamagnetic particles in the slurry can be attracted toward the wire and paramagnetic particles repelled (diamagnetic capture mode of operation); or vice-versa, for a magnetic field usually rotated by 90° with respect to the plane of the canister (paramagnetic capture mode of operation). Two or more laterally spaced outlets are provided at the bottom of the canister to collect the separated particles.

In the diamagnetic capture mode, the diamagnetic particles are obtained from the innermost outlets, that is, the outlet(s) nearer the wire, and the paramagnetic particles from the remote outlets. The converse obtains for the paramagnetic capture mode.

The apparatus of the invention permits continuous separation. Unlike conventional magnetic separators wherein particles are captured on the ferromagnetic wire, no wash-off process to clean up the filter is necessary after a certain collection period. The process is capable of handling a high concentration slurry, e.g., whole blood with a cell (red, white, etc.) concentration of about 50% by volume. Magnetic separation of low magnetic susceptibility materials can be performed with relatively high flow rate. For example, CuO particles of about 5.5 μm in radius, can be separated (one outlet clear) at 3.6 cm/sec flow velocity. With the apparatus of the invention, it is possible to use a permanent magnet to produce the magnetic field since it is not necessary to interrupt the field. Also, it is easy to perform a multistage operation to increase the selectivity.

By way of contrast with the Kelland-type separator, it may be deduced from the above, that the Kelland device does not utilize a purely radial force component for separation, but relies on a vector force which is a combination of radial and azimuthal components. Kelland's separator can separate paramagnetic from diamagnetic particles and vice versa; but because of the influence of the azimuthal force, it cannot effectively separate several species of paramagnetic (or diamagnetic) particles from each other.

On the other hand, because the azimuthal force in the present device is essentially zero, the apparatus of the present invention is capable of separating several paramagnetic (or diamagnetic) species from each other, in accordance with the susceptibility of each species or in accordance with their size if all the particles have the same magnitude and sign of susceptibility.

In a further embodiment of the invention, the single wire radial force apparatus of the invention is extended to an efficient technique of selective separation of particles, according to the particles magnetic susceptibility only; independent of density, size and shape of the particles. In this embodiment, a family of fluid streams are fed into a canister. Each stream differs from each other stream by the magnetic susceptibilities of the fluids in the family of streams. Thus, a susceptibility gradient is established in the canister, which may be used to separate particles in the stream. This method does not use the relatively slow technique of allowing a colloidal suspension of magnetic particles to sit in a magnetic field to establish a magnetic susceptibility gradient. Instead, the gradient is established before passing the fluids through the canister.

BRIEF DESCRIPTION OF THE DRAWINGS

FIGS. 7*a–f* are further alternate embodiments of the canister of FIG. 5.

BEST MODE OF CARRYING OUT THE INVENTION

Figure 1:
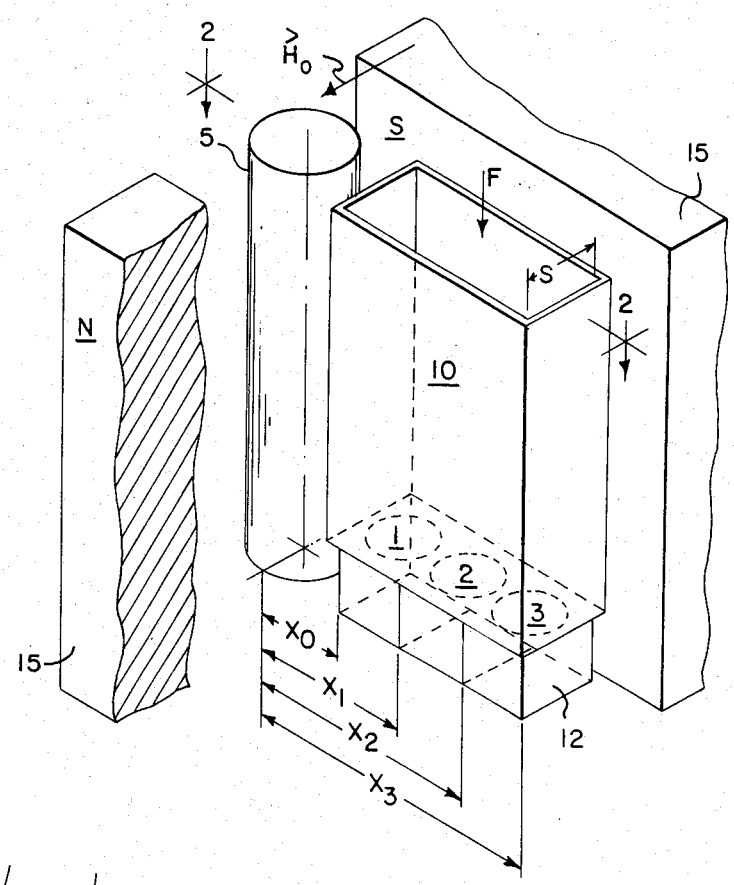
FIG. 1 is a schematic perspective representation of a diamagnetic capture mode magnetic separator of the invention with a generally rectangular inner cross-sectional canister.
Figure 2:
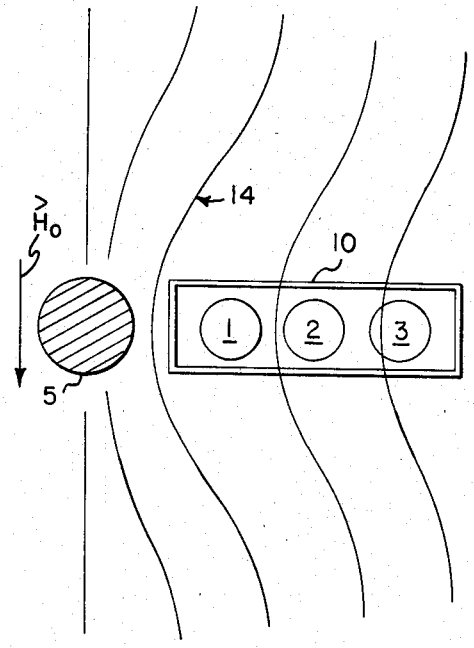
FIG. 2 is a section along lines 2—2 of FIG. 1 illustrating the magnetic gradient formed in FIG. 1.

FIGS. 1 and 2 show a schematic of a magnetic separator in accordance with the invention comprised of one ferromagnetic wire 5 and a thin rectangular non-magnetic canister 10 with multiple outlets 12 numbered 1 to n (in this case, n=3) from the wire side. In the apparatus of the preferred embodiment of FIGS. 1–4, the wire 5 is magnetized horizontally by a field $H_o$ provided by a suitable magnet 15 when the separator and the flow through it are vertical. In the FIG. 1 embodiment, the field is created perpendicular to the wire axis, as shown by the arrow $H_o$. The magnetic field may be seen to be directed perpendicular to the mid-plane of the canister and the central axis of the wire.

It should be noted, however, that in some applications, it may be desirable to rotate the field from a horizontal position, with respect to the wire, or to rotate the canister and wire from the vertical position. The latter case would be desirable where it is useful to minimize gravity effects. The main consideration is to cause the single wire 5 to be magnetized with a component transverse to its longitudinal axis, which in turn, results in a radial force existing everywhere within the cross-sectional area of the canister which is exerted on particles passing through the canister from one end to the other.

With the magnetic field arranged as in FIGS. 1–2, the canister is in the diamagnetic capture region, wherein diamagnetic particles flowing from the top to the bottom, or vice-versa, of the vertical length of the canister 10 are attracted toward the wires, and paramagnetic particles are repelled. This geometric configuration is called, herein, a "diamagnetic capture mode," wherein respective diamagnetic particles and paramagnetic particles are in respective "attractive force modes" and "repulsive force modes".

In the diamagnetic capture mode, the magnetic field lines (or flux lines) 14 would be uniform if the wire were not present, but with the wire present, the field lines are distorted, as shown in FIG. 2.

Where the field lines converge toward the wire (above and below the wire in FIG. 2) particles with positive relative susceptibility $(\chi_p-\chi_s)>0$, will experience a force toward the wire. On the other hand, to the right and left of the wire in FIG. 2, where the lines diverge, diamagnetic particles, or any particle with $(\chi_p-\chi_s)<0$, will also experience a "capture" force toward the wire.

Thus, in the embodiment of FIGS. 1 and 2, diamagnetic particles flowing through canister 10 in the direction of the arrow F will be attracted toward the wire 5 and collected at outlet 1.

Figure 3:
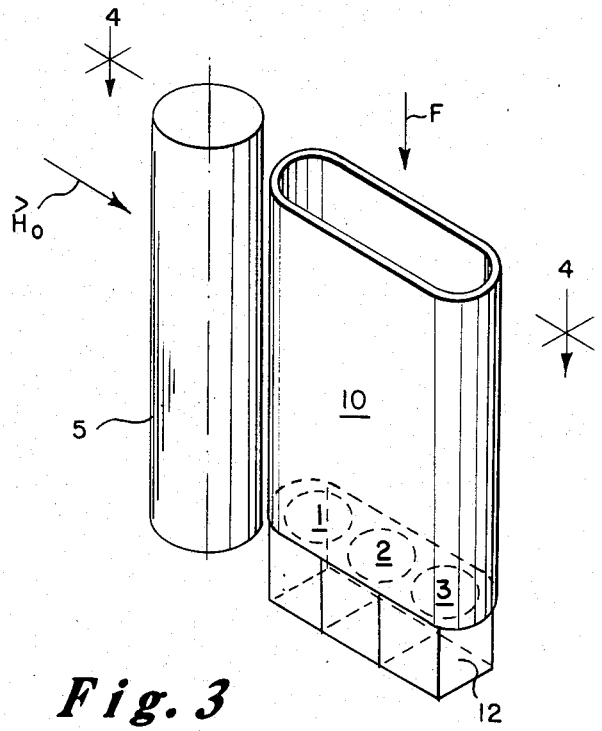
FIG. 3 is a schematic perspective representation of a paramagnetic capture mode magnetic separator of the invention with a generally oval inner cross-sectional canister.
Figure 4:
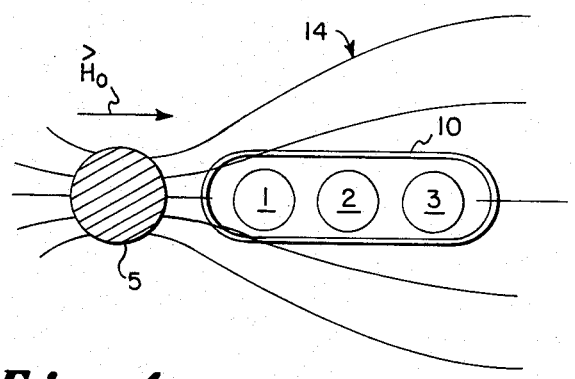
FIG. 4 is a section along lines 4—4 of FIG. 3 showing the magnetic gradient formed in FIG. 3.

FIGS. 3 and 4 correspond to respective FIGS. 1 and 2 except that the magnetic field $H_o$ has been rotated 90°, as shown by the arrow $H_o$ in FIGS. 3 and 4. The magnetic field may thus be seen in this embodiment to lie in a plane extending through the mid-plane of the canister and the wire axis. With this magnetic field orientation, the separator operates in the "paramagnetic capture" mode wherein paramagnetic particles and diamagnetic particles are in an attractive force mode and repulsive force mode, respectively. The embodiment of FIGS. 3 and 4 is the converse of FIGS. 1 and 2 and hence, paramagnetic particles are collected at outlet 1 and diamagnetic particles are collected at outlet 3 of FIGS. 3 and 4. In the case where the particles are all paramagnetic, the more strongly paramagnetic, i.e., with larger $\chi_p-\chi_s$, will be collected in the outlets near the wire. The weaker ones will be collected far from the wire. The same is true for all diamagnetic particles in the embodiment of FIGS. 1–2. It is important to note that greater selectivity is achieved for paramagnetic separations when the "diamagnetic capture" mode is chosen and the same is true for diamagnetic particles in the "paramagnetic capture" mode. Middlings are obtained from the #2 outlet.

A further embodiment of the invention will now be described in which the principles set forth above, with respect to a single stream of particles, will be expanded to permit continuous selective magnetic separation by magnetic susceptibility distribution.

Figure 5:
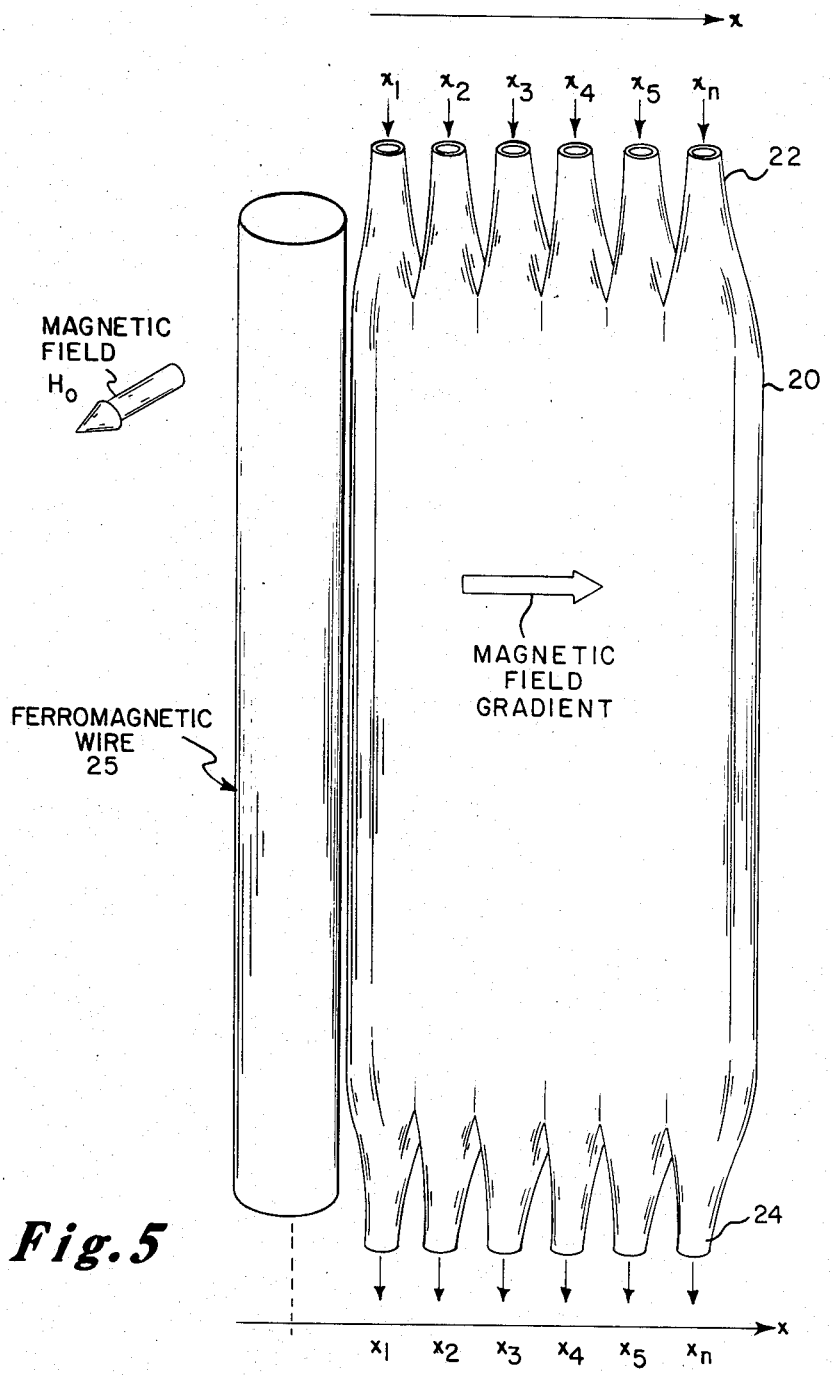
FIG. 5 is a perspective illustration of a continuous selective magnetic separation system embodiment using a family of streams of different fluid magnetic susceptibilities to establish a magnetic susceptibility gradient.
Figure 6A:
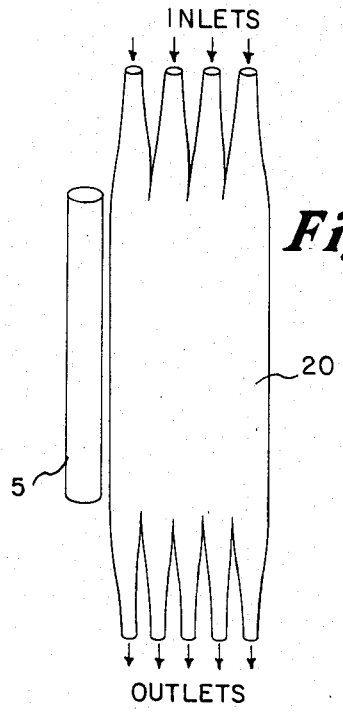
FIGS. 6*a–d* are schematicized illustrations of alternate embodiments of the canister of FIG. 5.
Figure 6B:
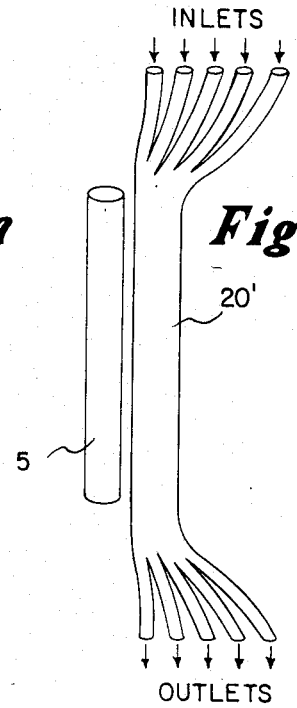
Figure 6C:
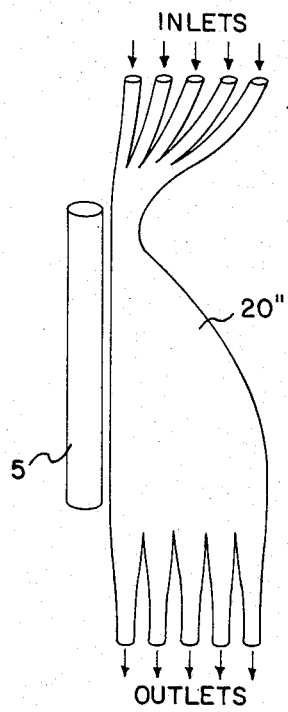
Figure 6D:
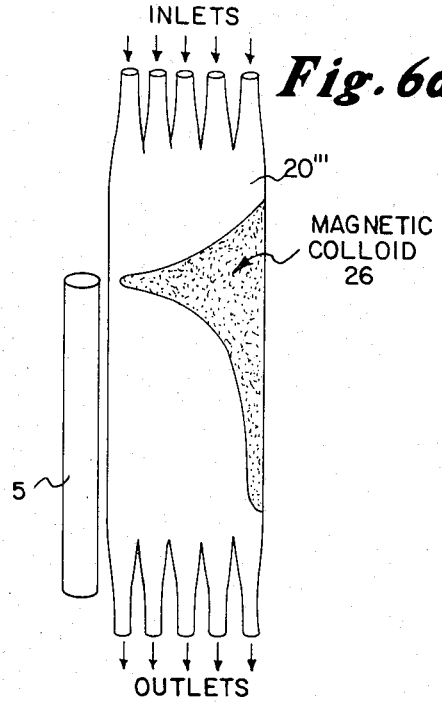

FIG. 5 may be used to illustrate the basic principle of this embodiment. The separation cell comprises a canister 20 having multiple inlets 22 and outlets 24. A family of magnetic fluids of different fluid magnetic susceptibilities $\chi_s=\chi_1, \chi_2 \cdots \chi_n$ $(\chi_1<\chi_2< \cdots \chi_n)$ is fed into the canister 20 from the inlets 22. FIG. 5 shows the "diamagnetic capture" mode. For the "paramagnetic capture" mode, the order of fluid stream susceptibilities is reversed, i.e. $(\chi_1>\chi_2> \cdots \chi_n)$. The flow stream forms a spatial distribution of magnetic susceptibility transverse to the flow direction. Through the diffusion process, the boundary between layers of the stream may become indistinct with residence time in the canister. Therefore, a reasonable flow velocity is used. When particles to be separated enter into the spatial distribution of susceptibility with a magnetic field gradient, they experience the magnetic force given by $$F_m=(\tfrac{1}{2})\mu_o V_p \nabla[(\chi_p-\chi_s)\vec{H}^2];$$

where $\chi_p$ is the susceptibility of the particles, $\vec{H}$ is the magnetic field, and $\mu_o$ is the permeability of vacuum and $V_p$ is the volume of the particle. The particles are moved by the magnetic force until they reach an equilibrium position x; in which "x" is the distance from the particle to the center of the wire 25, as shown in FIG. 1 and wherein the gradient term of the magnetic force $\nabla[(\chi_p-\chi_s)H^2]$ is equal to zero. If $\chi_s$ of the entering fluid is given by a step function, i.e., $\chi_s=\chi_n$ (constant) between $X_{n-1}$ and $X_n$, the particles of the magnetic susceptibility $\chi_p$ stay between the (n−1)th and nth streams since $\chi_{n-1}<\chi_p<\chi_n$. The particles can thus be recovered from one of the outlets 24, in accordance with their respective magnetic susceptibilities and/or sizes. Note that from the above equation it may be seen that the magnetic force ($F_m$) on a particle is a function of both particle susceptibility $\chi_p$ and size $V_p$. The product of these two parameters with the field forms the "magnetic moment" previously referenced.

The magnetic field gradient can be obtained using one or more magnetic wires, as shown in FIG. 5, or an electromagnet of a Frantz-Isodynamic separator, superconducting magnets, such as a magnet in use for open gradient magnetic separation, permanent magnets, or other specially designed magnets.

In the embodiment of FIG. 5, a single wire produces a field gradient in an otherwise uniform magnetic field.

Further embodiments of the separator of FIG. 5 are shown in FIGS. 6 and 7. FIG. 6 illustrates cross-sections of separators having a different number of the inlets and outlets 6*a* and different size and shape of the canister 20' and 20'' of FIGS. 6*a* and 6*c*. These modifications enable one to control the initial position of the entering magnetic and "non-magnetic" particles to obtain an effective and selective separation by reducing the distance required for a particle to travel transversely to the flow direction to reach its transverse equilibrium position in the flow stream. For the same purpose, a colloidal fluid of magnetic material 26, such as magnetite, can be used to form a dead flow region which serves to control the stream lines of flow, as in FIG. 6*d*.

Still further embodiments of the invention are set forth in FIGS. 7*a–e*. In embodiments 7*a–d*, the canister is in the form of convoluted member which folds back on itself, thereby extending the path through which the particles pass during separation without extending the linear length of the magnetic field. The wire 5 in FIG. 7*a* is shown adjacent to, and embedded in, a canister 20*a*, which is pervious to the electromagnetic field. The canister 20*a* is folded between the poles of magnet 12. In FIG. 7*b*, the canister is coil shaped to spirally wind around a superconducting magnet 28, which is used to generate the magnetic field; which field is distorted by wire 5 embedded in canister 20*b*. Alternatively, spiral canister 20*b* may be placed in a sinusoidal magnetic field.

In the apparatus of FIG. 7*c*, the canister 20*c* is in the form of a single pancake spiral in which eitr 5 is contained adjacent to one edge of the canister; whereas in FIG. 7*d*, the canister is in the form of a double back spiral.

In the embodiment of FIG. 7*e*, the canister 20*e* and wire 5*e* are tilted with respect to the gravitational field G, to partially compensate for gravitational effects on the particles. In the embodiment of FIG. 7*f*, the canister 20*f* is displaced at an angle to the wire 5*f*.

The following advantages of the embodiment of FIGS. 5–7 are noted:

(1) The method allows a continuous and selective separation.

(2) It is easy to adjust the fluid susceptibilities for a separation over a range of particle magnetic susceptibilities from diamagnetic to para- and ferromagnetic.

(3) Solutions of diamagnetic and paramagnetic salts can be used as magnetic fluids as an improvement over a single suspension of magnetic colloid.

(4) Relatively high flow rates can be applied. The present invention does not require use of a slow flowing colloidal suspension to establish a concentration of particles and, hence, susceptibility gradient. This is a relatively slow process. The present invention uses multiple fluids so the susceptibility gradient is already established before entering the field (separating) region. Therefore, the flow rate in the present invention is not limited at all by the need to make a susceptibility gradient.

EXAMPLES

Separation canisters 10 were made in accordance with the invention of thin, flat glass walls secured together with epoxy glue. A nickel wire 5 of 1 mm in diameter was fixedly mounted on one side of a rectangular canister similar to that of FIG. 1 but of much smaller scale. In a first example (Ex. 1), the canister had an inside width of S=0.5 mm without any insulation. In a second example (Ex. 2), S was made equal to 1 mm. Three outlets 12 were provided, made of a non-magnetic fine stainless steel cylindrical tube. (Ex. 1 Outer Diameter=0.5 mm, Ex. 2 Outer Diameter=1.0 mm).

The canister 10 was placed vertically in a horizontally applied magnetic field. A slurry was fed from bottom to top by a multichannel withdrawal syringe pump. The particle concentration of the slurry was measured by counting particle numbers for each particle size range, 2.7–45 μm, 4.5–7.5 μm, 7.5–12.5 μm, 12.5–17.5 μm, and 17.5–22.5 μm, using a PC-320 HIAC particle size analyzer. The particle number (concentrations) of the feed slurry were obtained from the slurry sample passed through the canister without the magnetic field. These were obtained prior to each run. The particle slurries were made in deionized water by mixing $MnCO_3$ ($\chi_p=3.84\times10^{-3}$ [SI]) with sodium phosphate tribasic as a dispersant or $Al_2O_3$ ($\chi_p=-1.81\times10^5$ [SI]) with a paramagnetic salt of 24 wt.% $MnCl_2$ ($\chi_s=4.2\times10^{-4}$ [SI]). Before the slurry preparation, the particles were sized between 3 μm and 20 μm by sedimentation. The concentration of the feed slurry was about 150 ppm. The flow velocity used in the calculations is the average value.

In FIG. 8, experimental results for an $MnCO_3$ slurry obtained by a three outlet single wire separator, as described above, are shown as a function of L*, together with theoretical calculated results. Note that L* is a dimensionless parameter which describes the particle motion in the separator of the invention and characterizes the operation of the separation process.

L* is derived as follows:

Assume that, in the present system, the thickness S of the canister is thin enough to neglect the effect of the azimuthal force experienced by the particles. In this case, paramagnetic and diamagnetic particles pass through the filter unless they are trapped respectively on the right and left short walls. In this system (the axial configuration with $\theta=0, \pi/2$) the position $x_1$ of a particle at the outlet which passes through a separator of length L is obtained from Equation 1 below:

$$L^*=\gamma[g(x_{oa})-g(x_{1a})]/4 \qquad \text{Equation (1)}$$

wherein $$L^*=(L/a)(|V_m|/v_o) \qquad \text{Equation (2)}$$

$$g(x)=x^4-\delta 2K_w x^2+K_w^2 \ln(x^2+\delta K_w) \qquad \text{Equation (3)}$$

where $\gamma$ is +1 for the attractive force mode, and −1 for the repulsive force mode, $\delta$ is +1 for the paramagnetic capture mode and −1 for the diamagnetic capture mode, $x_{1a}=x_1/a$ (normalized in terms of the wire radius a), $x_{oa}=x_o/a$ ($x_o$ is the entering position), $v_o$ is the flow velocity, $V_m$ is the magnetic velocity, $V_m=2\mu_o\chi M H_o b^2/9\eta a$, b is the particle radius, $\eta$ is the fluid viscosity, $\chi=\chi_p-\chi_s$, $\chi_p$ and $\chi_s$ are the susceptibility of the particles and fluid, respectively, $\mu_o$ is the permeability of vacuum, M is the magnetization of the wire ($M_s$ is the saturation value), and $K_w$ is $M_s/2H_o$ for $H_o>M_s/2$ and 1 for $H_o<M_s/2$.

Note that it is advisable to minimize azimuthal forces in the canister by constructing a canister having a narrow width less than or equal to the diameter of the wire.

Figure 8A:
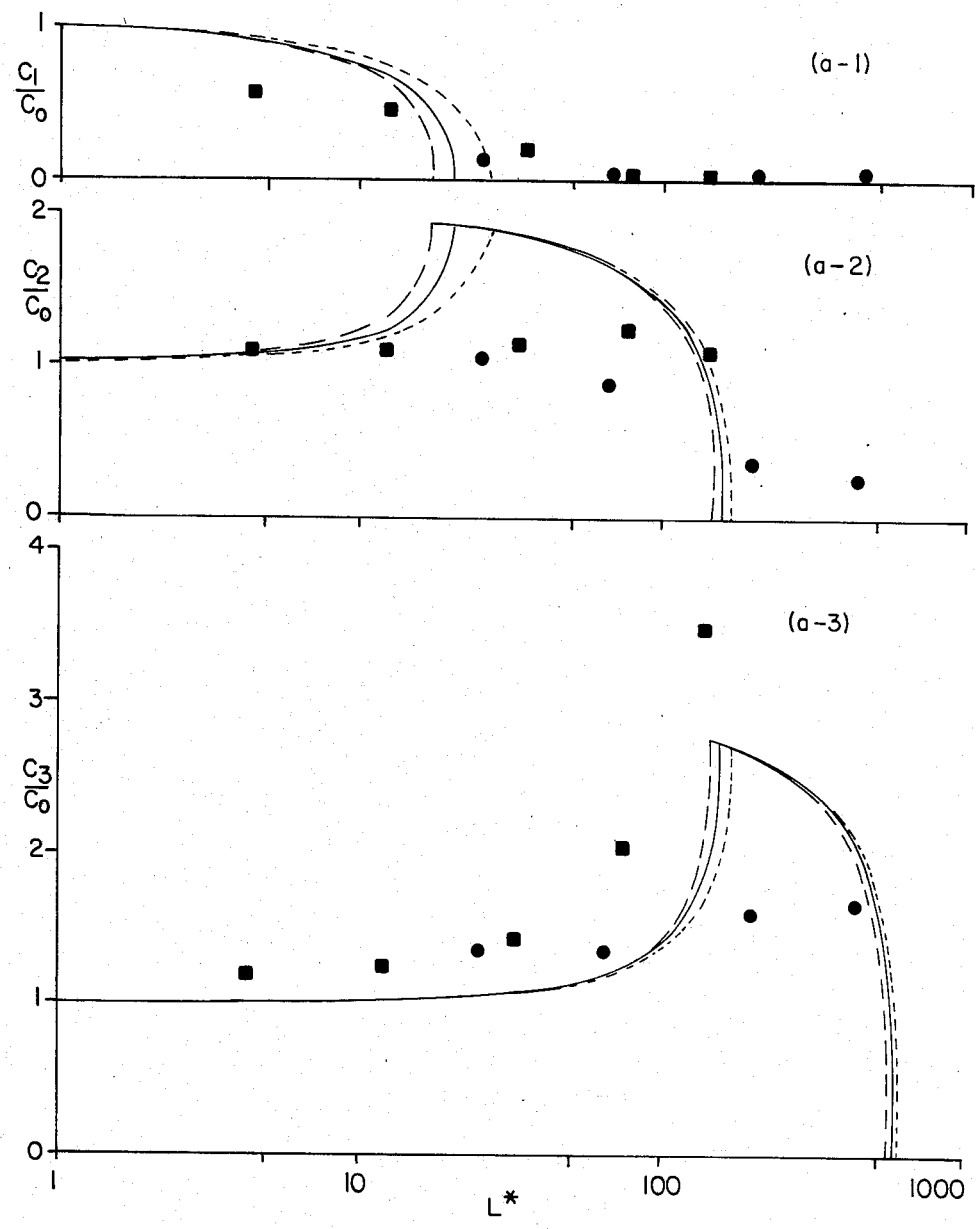
FIGS. 8*a–b* are plots of relative concentration for the three outlets of an experimental three outlet single wire separator versus L* along with theoretical curves.
Figure 8B:
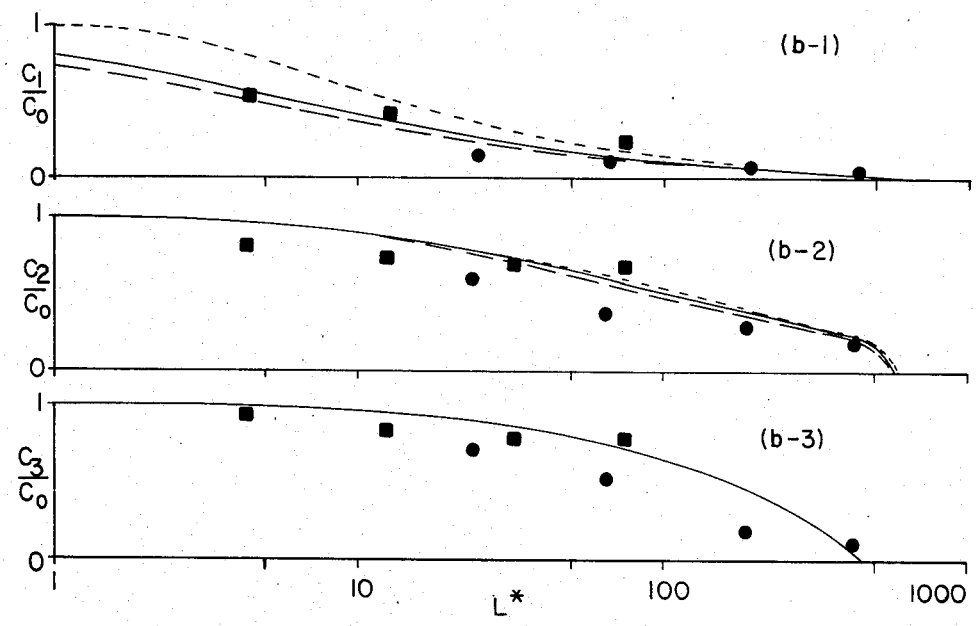
Figure 9:
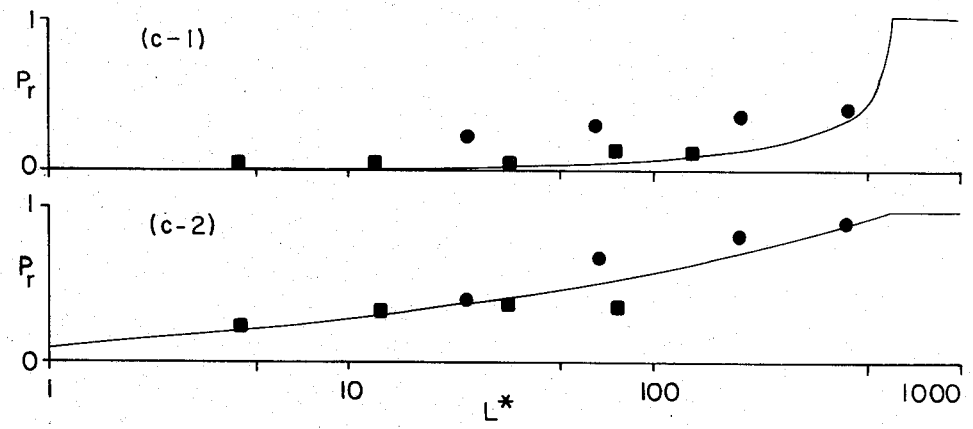
FIG. 9 is a plot of the experimental particle retentions $P_r$ versus L* and curves obtained by theoretical calculation.

The lines in FIG. 8 show the calculated values of the concentration of the outlet slurries both in the diamagnetic capture mode (—$K_w$=0 and - - - - $K_w$=0.99) and the paramagnetic capture mode (—$K_w$=0 and - - $K_w$=0.99)., (FIG. 8a-1,2,3); the repulsive force mode. FIG. 8b-1,2,3 shows the data for the attractive force mode. Particle retentions, $P_r$, in the repulsive force mode and the attractive force mode are shown in FIG. 9 (c-1) and (c-2), respectively. Each figure shows two sets of experimental results obtained for different average flow velocities $v_o$=12 mm/s. and 67 mm/s at $H_o=6.4\times10^5$ A/m. The length and the other dimensions of the separator were: L=68, a=0.5, $X_o$=0.5, $X_1$=1.5, $X_2$=2.5, $X_3$=3.5, and S=0.5 in mm. Each outlet (#1, #2, or #n) consisted of two 0.5 mm o.d. tubes. The six outlet tubes were led to a six channel syringe pump. A family of experimental data for different values of L* was obtained for different particle sizes (the average radii b [μm]=1.8, 3.0, 5.0, 7.5, and 10).

FIGS. 8(*a*) and (*b*) show the relative concentrations for the three outlets in the repulsive force mode and the attractive force mode, respectively. In FIG. 9, the experimental particle retentions $P_r$ obtained using Equation 4 below are plotted:

$$P_r=[c_o-(c_1+c_2+\ldots+c_n)/n]/c_o. \qquad \text{Equation (4)}$$

wherein $c_o$ equals the particle concentration of the feed slurry and $c_1$, $c_2$ and $c_n$ equals the concentration of particles at the respective outlets after separation.

As seen in FIG. 8, the greater difference between the concentrations $c_1$, $c_2$, and $c_3$ occurs for repulsive force mode with increasing L*. The retention, $P_r$, in the repulsive force mode is lower than that in the attraction force mode. These results indicate that the repulsive force mode is preferable for greater selectivity among materials with varied susceptibility and particle size.

Now we consider the capacity of the separator. Since the flow velocity $v_o$ is given by $v_o=LV_m/aL^*$ for a given operation parameter L* from Equation 2, the throughput Z, the volume of the slurry passing through the separator per unit time, can be written as, $$Q=[2|\chi|\mu_o b^2 M H_o L/9\eta L^*][(X_n-X_o)/a][S/a]. \qquad \text{Equation (5)}$$

If the cross sections of the separators are similar, that is, the values of $(X_n-X_o)/a$ and S/a are equal to each other, they give the same throughout Q, which does not depend on the wire size directly. The throughput Q increases with increasing separator length L, through a corresponding increase in $v_o$, and with increasing field $H_o$.

The agreements between experimental and theoretical results are good for the attractive force mode while those for the repulsive force mode are only fair. Even in the repulsive force mode, the profiles of the experimental results seen among $c_1$, $c_2$, and $c_3$ agree qualitatively with the theoretical prediction. It is noted that the ratio $c_3/c_1$ can be of the order of 50.

Simplifications taken in the theoretical calculation may be more applicable to the attractive force mode than to the repulsive force mode, since the azimuthal force and the effects of the canister wall were neglected. In the repulsive mode, particles hitting the far wall were assumed to remain there in the theoretical calculation. The greater value of the experimental results of $c_3$ at higher flow velocity $v_o=67$ mm/s in FIG. 8(a-3) than theory predicts might be the results of the collection of those particles washed off from the wall by the higher drag force. The calculation assumed ideal flow, i.e., the velocity is everywhere constant and parallel whereas the actual flow is probably more nearly laminar. In that case, the velocity distribution across the cross-section of the canister would be approximately parabolic. The flow velocity of the #2 outlet stream is greater than that of the outer streams. This correction would result in a shift to the right side of the experimental results of $c_1$ and $c_3$ in FIG. 8(*a*), while the results for $c_2$ shift to the left. This would make the agreement between theoretical and experimental results better for $c_1$ and $c_3$ in the repulsive force mode. There would be little effect for $c_2$. In actual practice, there is an added complexity in the flow pattern due to end effects at both ends of the canister.

SUMMARY

A single wire separator with multiple outlets in the repulsive force mode allows continuous separation with greater selectivity than that in the attractive force mode. The formation and operation of the separator would be made easier by adopting a relatively large ferromagnetic wire. To increase the efficiency of the separator, the separator can be made longer or a multiple wire array composed of single wire units with multiple outlets can be used.

The multiple outlet separator has great advantages for separation of weakly magnetic materials and especially submicron particles. It can be applied to dry separations. To increase selectivity for a separation between diamagnetic and paramagnetic particles, multi-stage operation can be employed by combining a paramagnetic capture mode and a diamagnetic capture mode. It is also possible to use a permanent magnet to produce the magnetic field, since it is not necessary to interrupt the field.

In a further embodiment of the invention, the single wire radial force apparatus of the invention is extended to a system for selective separation of particle, according to the particles magnetic susceptibillity only; independent of density, size and shape of the particles. In this embodiment, a family of streams are fed into the canister. Each stream differs from each other stream by the magnetic susceptibilities of the fluids in the family of streams. A susceptibility gradient is thus established in the canister, which is used to separate particles in the stream.

EQUIVALENTS

Those skilled in the art will recognize many equivalents to the specific embodiments described herein. For example, generally oval shaped (See FIGS. 3 and 4), as well as a generally rectangular shaped construction for the container is contemplated. Such equivalents are part of this invention and are intended to be covered by the following claims.

We claim:

1. A magnetic separator comprising:

(a) a non-magnetic canister having an inner cross-sectional relatively narrow space between two opposing walls of said canister; and an inlet port at one end of said canister for receiving a flow of particles within the longitudinal inner narrow space of the canister;

(b) a single ferromagnetic wire disposed outside of, and adjacent to and extending along the length of said canister;

(c) magnetic means for magnetizing the wire with a magnetization component transverse to its longitudinal axis to create a radial force substantially everywhere in said narrow space between the two opposing walls of said canister, which force is imparted to particles passing through the space with substantially no azimuthal forces in such narrow space; and (d) outlet ports in said canister at an end opposite the inlet port and laterally spaced from said wire for collecting said particles in accordance with their magnetic moment.

2. The separator of claim 1 wherein some of the particles are paramagnetic and some are diamagnetic and the paramagnetic particles are collected at outlet ports near the wire and diamagnetic particles at outlet ports remote from the wire.

3. The separator of claim 1 wherein some of the particles are paramagnetic and some are diamagnetic and the diamagnetic particles are collected at outlet ports near the wire and paramagnetic particles at outlet ports remote from the wire.

4. The separator of claim 1 wherein all of the particles have the same susceptibility and are collected at different outlet ports in accordance with the size of the particles.

5. The separator of claim 1 wherein all of the particles are of the same size and are collected at different outlet ports in accordance with the susceptibility of the particles.

6. The separator of claim 1 wherein the magnetic means comprises a magnet selected from the group comprising superconducting magnets, permanent magnets, solenoid electromagnets and non-bound electromagnets.

7. The separator of claim 1 wherein the magnetic field $H_o$ of the magnetic means lies in a plane extending through the mid-plane of the canister and the wire axis.

8. The separator of claim 1 wherein the magnetic field $H_o$ of the magnetic means is directed perpendicular to the mid-plane of the canister and the wire axis.

9. The separator of claim 1 wherein the magnetic field $H_o$ of the magnetic means is non-perpendicular to the longitudinal axis of the wire.

10. The separator of claim 1 wherein the canister is displaced at an angle to the wire.

11. The separator of claim 1 wherein the ratio of the diameter of the wire to the thin width of the space is at least one.

12. The separator of claim 1 wherein all of the particles have a susceptibility of the same sign and particles with a higher magnitude of magnetic moment are collected at certain outlet ports and particles with lesser magnitude of magnetic moment are collected at certain other outlet ports.

13. The separator of claim 1 wherein the canister is disposed at an angle with respect to the direction of the gravitational force.

14. A magnetic separator comprising:

(a) a canister having an inner elongate relatively thin cross-sectional space and an inlet port for receiving a flow of paramagnetic and diamagnetic particles through the longitudinal extent of the inner space of the canister;

(b) a ferromagnetic wire disposed outside of said canister and adjacent to the longitudinal dimension of said canister;

(c) magnetic means for magnetizing the wire with a magnetic component transverse the longitudinal axis of the wire such that substantially everywhere in the inner space of the canister a radial force is exerted on particles passing therethrough and substantially no azimuthal forces are exerted on said particles; and (d) outlet ports in said canister opposite the inlet port and laterally spaced from said wire for collecting said particles in accordance with their magnetic moment.

15. The separator of claim 14 wherein paramagnetic particles are collected at outlet ports near the wire and diamagnetic particles at outlet ports remote from the wire.

16. The separator of claim 14 wherein diamagnetic particles are collected at outlet ports near the wire and paramagnetic particles at outlet ports remote from the wire.

17. The separator of claim 14 wherein the shape of the cross-sectional space is generally rectangular.

18. The separator of claim 1 or 14 wherein the shape of the cross-sectional space is generally oval.

19. The separator of claim 1 or 14 wherein the canister and its adjacent wire are in the shape of a spiral.

20. A magnetic separator for separating particles which have the same susceptibility comprising:

(a) a non-magnetic canister having a generally rectangular inner cross-section with a relatively narrow space between two opposing walls of said canister; and a plurality of inlet ports at one end of said canister for receiving a flow of said particles within the longitudinal inner narrow space of the canister each port being coupled to a fluid of different fluid magnetic susceptibility such that flow of such fluids through the canister forms a spatial distribution of magnetic susceptibility transverse to the direction of fluid flow;

(b) a single ferromagnetic wire disposed adjacent to and extending along the length of said canister;

(c) magnetic means for magnetizing the wire with a magnetization component transverse to its longitudinal axis to create a radial force everywhere in the narrow space adjacent to the wire, which force is imparted to particles passing through the space; and (d) outlet ports in said canister at an end opposite the inlet port and laterally spaced from said wire for collecting said particles in accordance with their size.

21. The separator of claim 20 wherein the magnetic susceptibility of the fluid is altered by mixing the fluid with a paramagnetic salt.

22. The separator of claim 20 wherein the magnetic susceptibility of the fluid is altered by forming a colloidal suspension of magnetic material with the fluid.

23. The separator of claim 20 wherein the magnetic susceptibility of the fluid is altered by mixing the fluid with a diamagnetic salt.

24. A method of magnetic separation comprising the steps of:

(a) introducing a flow of particles through an inlet port to a non-magnetic canister having a generally rectangular inner cross-section with a relatively narrow space between two opposing walls of said canister; an inlet port at one end of said canister;

(b) disposing a single ferromagnetic wire adjacent and external to and extending along the length of said canister;

(c) magnetizing the wire with a magnetization component transverse to its longitudinal axis to create a radial force substantially everywhere in the narrow space adjacent to the wire, which force is imparted to particles passing through the space and substantially no azimuthal force is exerted thereon; and (d) collecting said particles in accordance with their magnetic moment.

25. The method of claim 24 wherein some of the particles are paramagnetic and some are diamagnetic and paramagnetic particles are collected near the wire and diamagnetic particles remote from the wire.

26. The method of claim 24 wherein some particles are diamagnetic and some are paramagnetic and the diamagnetic particles are collected at outlet ports near the wire and the paramagnetic particles at outlet ports remote from the wire.

27. A method of magnetic separation comprising the steps of:

(a) introducing a flow of particles to a canister having an inner cross-sectional space for receiving a flow of particles through the longitudinal extent of the inner space of the canister;

(b) disposing a ferromagnetic wire adjacent and external to the longitudinal dimension of said canister;

(c) magnetizing the wire with a magnetic component transverse the longitudinal axis of the wire such that substantially everywhere in the inner space of the canister a radial force is exerted on particles passing therethrough and substantially no azimuthal forces are exerted thereon; and (d) collecting said particles in accordance with their magnetic moment.

* * * * *